US005673988A

United States Patent [19]

Fujita

[11] Patent Number: 5,673,988

[45] Date of Patent: Oct. 7, 1997

[54] CHEMICAL LUMINESCENCE APPARATUS

[75] Inventor: Masahiko Fujita, Koga-Machi, Japan

[73] Assignee: Nihon Kagaku Hakko K.K., Fukuoka, Japan

[21] Appl. No.: 389,824

[22] Filed: Feb. 15, 1995

[51] Int. Cl.[6] ..... F21K 2/06

[52] U.S. Cl. ..... 362/34; 362/159; 362/396

[58] Field of Search ..... 362/34, 396, 159, 362/209, 84; 43/17.5, 17.6

[56] References Cited

U.S. PATENT DOCUMENTS

| | | | |
|---|---|---|---|
| 3,863,380 | 2/1975 | Purlia | 43/17.6 |
| 5,043,851 | 8/1991 | Kaplan | 362/34 |
| 5,213,405 | 5/1993 | Giglia | 362/34 |

FOREIGN PATENT DOCUMENTS

| | | | |
|---|---|---|---|
| 2232268 | 1/1975 | France | 43/17.6 |

*Primary Examiner*—Stephen F. Husar
*Assistant Examiner*—Sara Sachie Raab
*Attorney, Agent, or Firm*—Armstrong, Westerman Hattori, McLeland & Naughton

[57] ABSTRACT

A chemical luminescence apparatus comprises a tube container, having an open top, which contains a first chemical luminous liquid and an ampul which in turn contains a second chemical luminous liquid, chemically reactive with the first chemical luminous liquid for producing a luminescent reaction product, wherein the open top of the tube container is hermetically sealed by a cap at a lower portion of such cap. At the upper surface of the cap is formed a groove to which upstanding walls of a mount member, a stand member, or a coupler are detachably mounted, thereby enabling not only wide range uses of the apparatus, but also enabling maintenance operation, such as exchange of parts, to be easily performed.

11 Claims, 15 Drawing Sheets

CHEMICAL LUMINESCENCE APPARATUS

BACKGROUND OF THE INVENTION

The present invention relates to a chemical luminescence apparatus adapted to wide range of use, such as lights for camping, mountaineering, events, parties, jogging, scuba diving, night fishing and so on, safety lamps at construction sites or accident spots, emergency lamps in cases of earthquakes or floods, lights for luring fish at night fishing, underwater lights for scuba diving, or notice lights for being attached to life jackets or lifeboats.

Conventionally, a chemical luminescence apparatus of this kind includes a milky colored tube container, made of PE (polyethylene), filled with a first chemical luminous liquid and a second chemical luminous liquid, which are chemically reactive with each other, to produce a luminesent reactive product, wherein one of the chemical luminous liquids is sealed into an ampul disposed within a tube containing the other luminous liquids. Such containers are translucent and include a hook, one end of which is bent, and integrated with an end of the sealed container.

According to such a conventional chemical luminescence apparatus, when the ampul is broken, such as, by bending the tube container, the second chemical luminous liquid in the ampul and the first chemical luminous liquid in the container react to emit light, but light transmittance thereof is bad. In the tube container which does not have a hanger portion such as a hook, it is impossible to hang the container on ropes and the like. Thereby, the place to be hung is limited.

On the other hand, if the apparatus includes a hook or an engaging aperture, wherein the hook or the aperture is integrated with the tube container made, for example, of PE (polyethylene), where in the hook or the aperture is of PE (polyethylene), such portions are easily expanded or broken.

In case of using the chemical luminescence apparatus as an emergency lamp, the light emitted therefrom is partially shaded because it has no grip or stand for supporting such apparatus on a table.

SUMMARY OF THE INVENTION

The present invention solves the above problems. Thus, it is an object of the present invention to provide a chemical luminescence apparatus including a detachable mount member or a detachable stand member having an engaging portion and easily adapted to various members or placed, such as a balanced position on the surface of a table members.

Another object of the present invention is to provide a chemical luminescence apparatus, wherein the mount member or the stand member is manually changed, quickly and surely, one to others.

Still another object of the present invention is to provide a chemical luminescence apparatus, wherein one tube container can be coupled with another tube container, whether or not empty.

Yet another object of the present invention is to provide a chemical luminescence apparatus, wherein not only transmittance of the tube but also rigidity of the mount member, the stand member, or the coupler is improved.

It is a further object of the present invention to provide a chemical luminescence apparatus, wherein the mount member, stand member, or the coupler cannot be easily removed from the tube container under such unusual circumstances unless a strong external force is applied.

To attain the above-mentioned objects, the present invention comprises a tube container filled with first and second chemical luminous liquids which are chemically reactive with each other, one of such chemical luminous liquids being sealed into an ampul disposed within the tube container, wherein a detachable mount member, having a hook or a clip, can be attached to a cap of the tube container.

According to one preferred mode of the present invention, the chemical luminescence apparatus comprises a tube container filled with first and second chemical luminous liquids which are chemically reactive with each other, one of the chemical luminous liquids being sealed into an ampul disposed in the other chemical luminous liquid within the tube container, wherein a detachable stand member or a detachable stand member with a base and legs can be attached to a cap of the tube container.

According to another preferred mode of the present invention, at least one of two tube containers includes one of the chemical luminous liquids and an ampul sealed with the other chemical luminous liquid disposed therewithin and each of the tube containers has a cap which can be linked with a cap on the other container through a coupler detachable to such caps.

In the chemical luminescence apparatus, according to the present invention, which is constructed, as described above, so that the mount member, the stand member, or the coupler are formed separate, not only from the tube container but also from the cap integrated therewith, the tube container is composed of a material with high light transmittance while the mount member, the stand member, or the coupler are made of highly rigid materials which are different from that of the tube container, thereby the degree of freedom, in terms of the choice of the materials to be used, is increased.

Further, because the chemical luminescence apparatus, according to the present invention, includes such attachments as the mount member, the stand member, or the coupler detachably mounted to the tube container, the interchangeability of the attachments can be attained, which, in turn, enables not only wide range uses to be possible according to the purposes but also maintenance operation, such as exchange of parts, to be easily performed.

In this specification, a description "detachably mounted to" basically means easily removable and securable (attachments) only by use of human hands, however, under the special circumstances, it refers to a firm engagement to be secured and removed with tools.

BRIEF DESCRIPTION OF THE DRAWINGS

FIG. 26(*a*) is an enlarged fragmentary view of the chemical luminescence apparatus shown in FIG. 26.

DETAILED DESCRIPTION OF THE PREFERRED EMBODIMENT

Preferred embodiment of the present invention will now be described in detail with reference to the accompanying drawings. In these FIGS., the same reference numbers are allotted to the parts as allotted to the corresponding parts therebetween in order to eliminate overlapping explanation, and differences will be described principally hereinbelow.

FIG. 1 through FIG. 14 show the first embodiment of the chemical luminescence apparatus according to the present invention.

Figure 1:
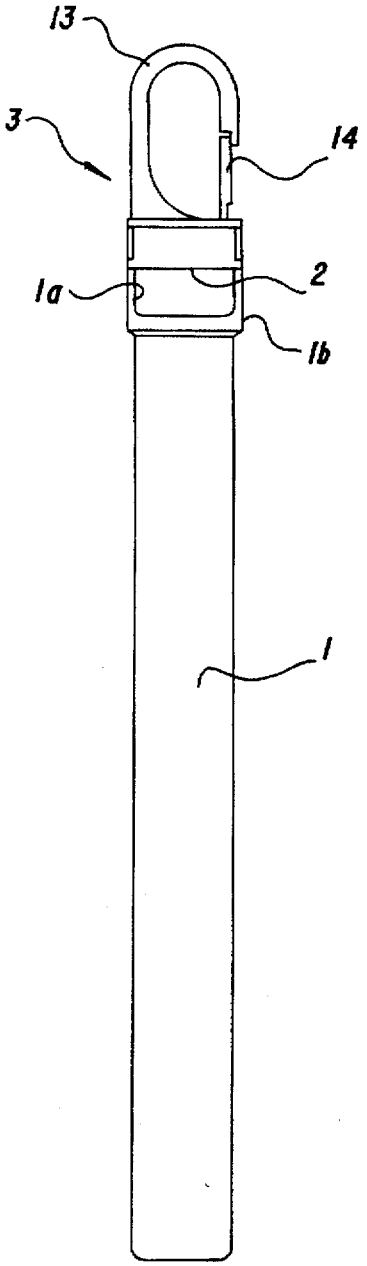
FIG. 1 is an illustrative elevational view of the first embodiment of the chemical luminescence apparatus according to the present invention.
Figure 2:
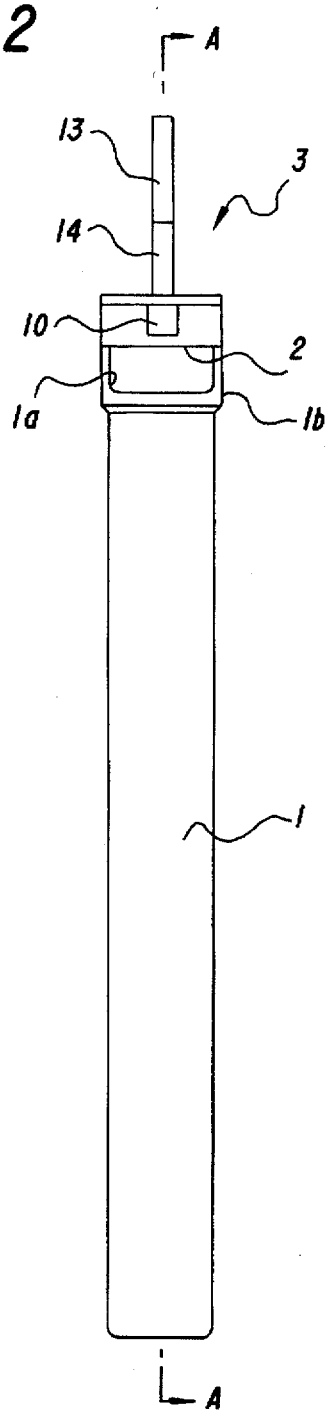
FIG. 2 is a right side view of the chemical luminescence apparatus shown in FIG. 1.
Figure 3:
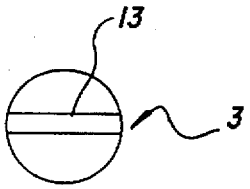
FIG. 3 is a plan view of the chemical luminescence apparatus shown in FIG. 1.
Figure 4:
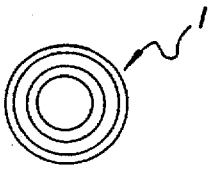
FIG. 4 is a bottom view of the chemical luminescence apparatus shown in FIG. 1.
Figure 5:
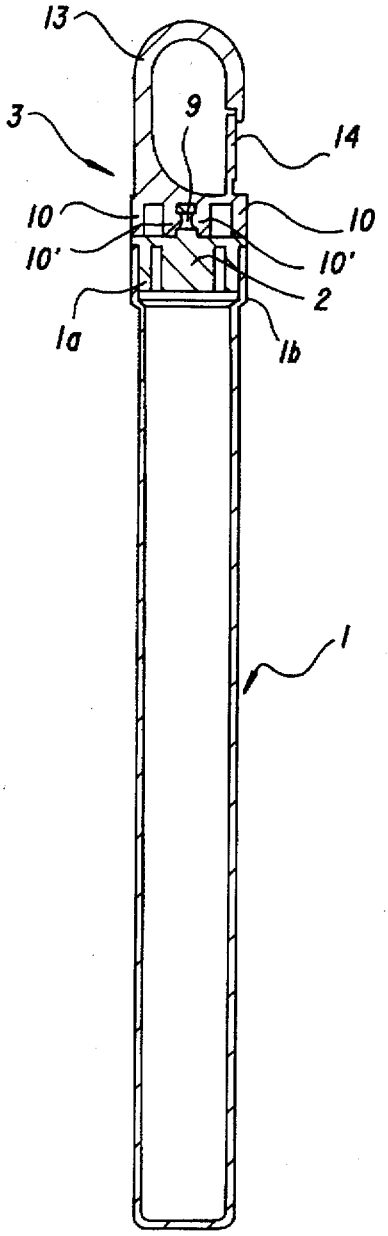
FIG. 5 is a sectional view as viewed in the direction of arrow A—A in FIG. 2.

As shown in FIGS. 1, 2, and 5, the chemical luminescence apparatus includes a tube container 1 which is a cylindrically shaped tube having a closed bottom and an open top and made from PP (polypropylene), with uniform thickness of about 1.2 mm and height of about 14 cm, a cap 2 covering an opening portion 1*a* of the tube container 1, and a mount member 3 detachably mounted to the upper portion of the cap 2.

Figure 6:
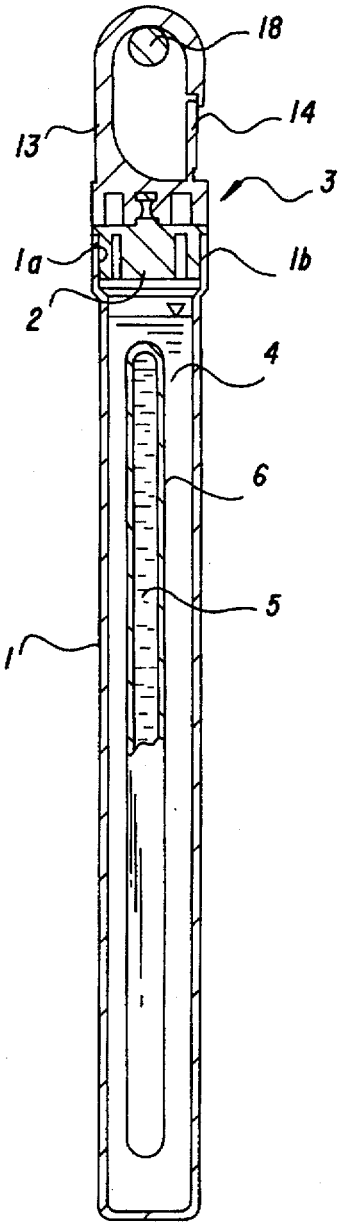
FIG. 6 is a fragmentary elevational view showing the first embodiment of the chemical luminescence apparatus in a using condition.

As shown in FIG. 6, a first chemical luminous liquid 4 is filled within the tube container 1 except for a small space S. In the chemical luminous liquid 4, an ampul 6 containing a second chemical luminous liquid 5 is floating therewithin.

The tube container 1, FIG. 1, includes a thick portion 1*b* at the upper portion thereof, with larger diameter than that of the lower portion thereof, and the opening portion 1*a* is formed at the upper end of a thick portion 1*b*. The opening portion la is hermetically sealed by means of the cap 2 fixed thereto. As shown in FIG. 11 through FIG. 14, the cap 2 includes a distal base portion 31, a fit-in portion 12, formed on the lower surface of the base portion 31, for fitting in the opening portion 1*a* of the tube container 1, and an engaging portion 30, formed on the upper surface of the base portion 31, for attaching the mount member 3 thereto, all of which are integrally formed from material, such as, PP (polypropylene).

Figure 13:
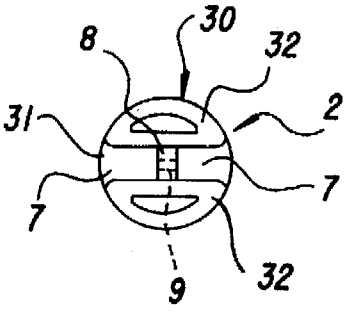
FIG. 13 is a plan view of the cap shown in FIG. 11.
Figure 12:
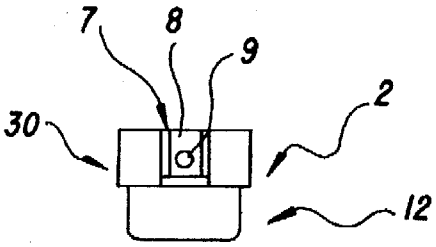
FIG. 12 is a right side view of the cap shown in FIG. 11.
Figure 9:
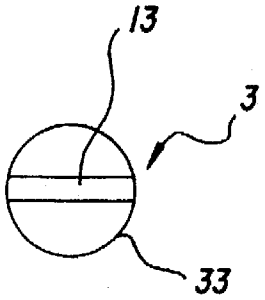
FIG. 9 is a plan view of the hook-shaped mount member shown in FIG. 7.

As will be understood from FIG. 12 and FIG. 13, the engaging portion 30, forming a mirror symmetry with respect to the diameter of the base portion 31, includes a segmental projecting portion 32, 32, FIG. 13, confronted each other and elongated upwardly in a vertical direction from the upper surface of the base portion 31, and a connecting member 8 disposed between the two projecting portion 32, 32 to form a grooves 7, 7 on the upper surface of the base portion 31. The grooves 7, 7, as shown in FIG. 13, are partitioned by the connecting member 8 having an aperture 9 in communication therewith.

Figure 14:
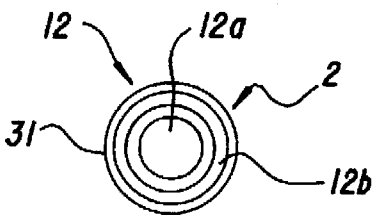
FIG. 14 is a bottom view of the cap shown in FIG. 11.
Figure 11:
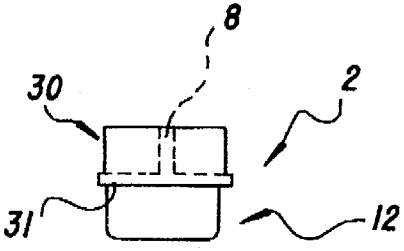
FIG. 11 is an elevational view of a cap adapted to the first embodiment of the chemical luminescence apparatus.

On the other hand, as shown in FIG. 14, the fit-in portion 12 includes a columnar central portion 12*a*, elongated downwardly in a vertical direction from the lower surface of the base portion 31, and an annular cylindrical engaging strip 12*b* which surrounds the outer peripheral surface of the central portion 12*a*, at a distance therefrom. Further, the outer diameter of the engaging strip 12*b* is slightly larger than the inner diameter of the opening portion 1*a*, FIG. 5, so that the two members, when the engaging strip 12*b* is inserted in the opening portion 1*a* and then turned therewithin, can be melted, through rotational friction heat, to be fixed together.

On the upper surface of the cap 2 of the chemical luminescence apparatus body, as described above, the mount member 3, made of such material as PP (polypropylene), can be attached thereto (as described later). That is, as shown in FIG. 7 through FIG. 10, the mount member 3 includes a distal base portion 33, four substantially parallel upstanding walls 10, 10', 10', 10, to be fitted in the projecting portion 32 of the cap 2, FIG. 13, extending substantially orthogonally from the base portion 33, and a hook portion 13, FIG. 7, elongated upwardly in a vertical direction from the upper surface of the base portion 33.

The hook portion 13 is reversely U-shaped as a whole, one leg portion of which includes a opening portion at the lower portion thereof, and a locking strip 14 which is resiliently hinged at the lower thin portion on the base portion 33 and is normally urged to close the opening portion. As shown in FIG. 6, the chemical luminescence apparatus can be mounted to fixed members, such as rope 18, by inwardly pushing the locking strip 14 of the hook portion 13 and engaging rope 18 in hook portion 13.

Figure 7:
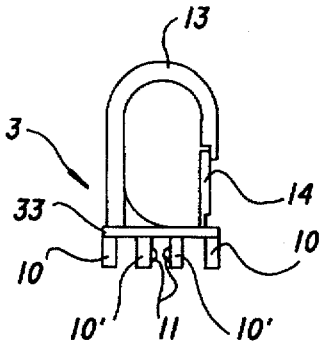
FIG. 7 is an elevational view of a hook-shaped mount member adapted to the first embodiment of the chemical luminescence apparatus.
Figure 8:
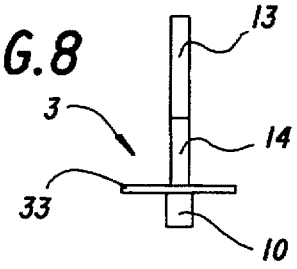
FIG. 8 is a right side view of the hook-shaped mount member shown in FIG. 7.
Figure 10:
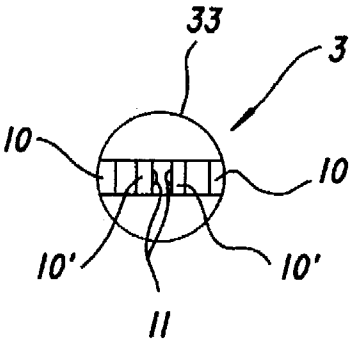
FIG. 10 is a bottom view of the hook-shaped mount member shown in FIG. 7.

As shown in FIG. 7 and FIG. 10, the upstanding walls 10, 10' are formed identical in height (depth) and width (length) with the groove 7, FIG. 12, (connecting member 8) of the cap 2. The inner upstanding walls 10', 10', FIG. 10, thinner than outer upstanding walls 10, 10, are more resilient than the outer upstanding walls 10, 10. The inner upstanding walls 10', 10' are disposed, so that the distance therebetween is substantially the same as the thickness of the connecting member 8. Further, hemispherical detents 11, 11, confronting each other, are formed on the inner surface of each of the inner upstanding walls 10', 10'.

The mount member 3 of the chemical luminescence apparatus according to this embodiment, constructed as described above, can be mounted to the cap 2, simply by positioning the mount member 3 so that the connecting member 8 of the cap 2 can be located at the space between the two inner upstanding walls 10', 10', and then pushing down the mount member 3, by hand, easily fitting the inner upstanding walls 10', 10' into the groove 7 of the cap 2. That is, when the mount member 3 is pushed down, the detents 11, 11 of the inner upstanding walls 10', 10' contact the opposite sides of the connecting member 8, therebetween, and the inner upstanding walls 10', 10' are slidablly moved downwardly, with their lower end portions extended, to the aperture 9, FIG. 12, of the connecting member 8 in which the detents 11, 11 are engaged. The inner upstanding walls 10', 10' are restored to the original state, which, in turn, enables the mount member 3 to be firmly fixed to the cap 2 (FIG. 5). In this way, all the four upstanding walls 10, 10' are inserted into the groove 7 to be integrally fixed, without movement in any direction, to the tube container 1.

Then the mount member 3 is removed from the cap 2, you have only to push the mount member 3 upwardly by hand, and the like, so that the detent 11, FIG. 7, of the inner upstanding walls 10', 10' can be released from the aperture 9, FIG. 13, of the connecting member 8, thereby the mount member 7 can be easily removed from the cap 2. Thus, the mount member 3 can be easily detachably mounted to the tube container 1.

Figure 15:
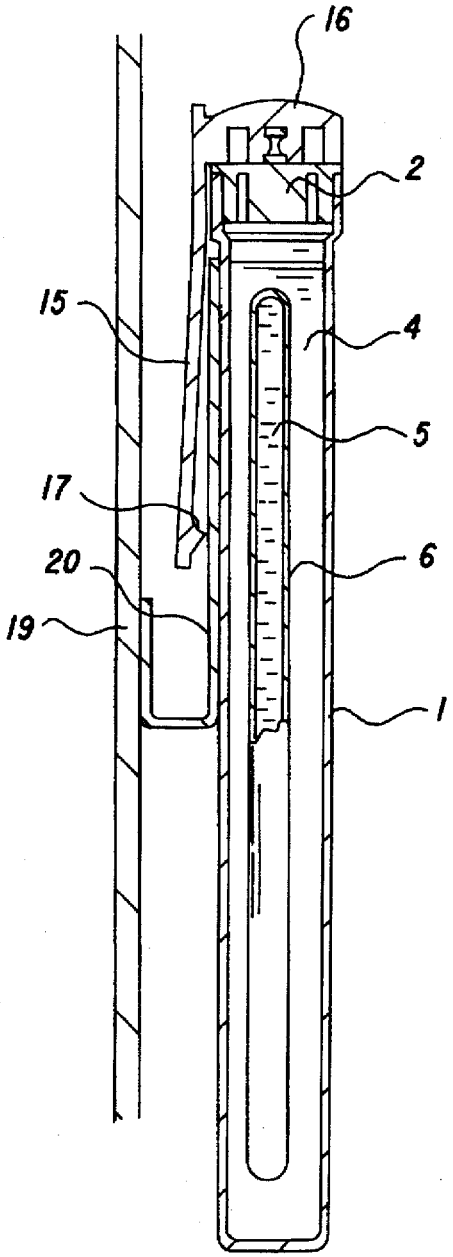
FIG. 15 is an illustrative view of the second embodiment of the chemical luminescence apparatus according to the present invention in a use condition.

When the chemical luminescence apparatus, according to this embodiment, constructed as described above, is used for a light source, you have only to bend the tube container 1, such as, by means of external force by hand, so that the ampul 6, FIG. 15, containing one of the chemical luminous liquids can be broken, with the result that the first and second chemical luminous liquids within the tube container 1, are mixed, thereby chemically reacting and emitting light.

Such container, emitting light, as described above, is hooked on the fixed member, such as rope 18, disposed at the sites where the light is needed. The chemical luminescence apparatus, emitting light, is easily hooked on the rope 18 by simply inserting the rope 18 into the hook portion 13 through the opening portion thereof, which is opened when the locking strip 14 is pushed inwardly, thereby effectively illuminating the surroundings thereof. Because the locking strip 14 is normally urged, in a outward direction, to close the opening portion after mounting the rope 18, the chemical luminescence apparatus cannot be dropped or blown off under circumstances, such as, a strong wind.

Further, because attaching and detaching the mount member 3 to the cap 2 can be performed by a human hand, the mount member 3 can be easily exchanged, as described later, to another mount member 16, with the result that the chemical luminescence apparatus according to the present invention, can extend over a wide area of usage.

Furthermore, because the mount member 3 is constituted separate from the tube container 1 and the cap 2 fixed thereto by heat seal, the tube container 1 can be made of materials with high light transmittance while the mount member 3 can be made of highly rigid materials which are different from that of the tube container 1, thereby the degree of freedom in terms of the choice of the materials to be used is increased. Therefore, the problems accompanied with the apparatus, in which the tube container and the mount member are formed integrally with the same material, are solved. That is, as will be apparent, in case of using the low rigid material for the mount member 3, due to a high value on light transmittance rather than high rigidity, the mount member 3, lowering its rigidity, is easily extended, cut off, bent, or warped. On the contrary, in case of using the high rigid material for the tube container 1, due to a high value on high rigidity rather than high transmittance, the tube container 1 lowers its transmittance and is difficult to bend by a hand when luminating. Those problems mentioned above can be solved by the chemical luminescence apparatus according to the present invention.

As will be apparent from the description above, when a chemical luminescence apparatus, according to the present invention, is used for a light source, such as a light for camping, mountaineering, events, parties, jogging, scuba diving, night fishing and so on, a safety lamp at construction sites or accident spots, an emergency lamp in cases of earthquakes or floods, a light for luring fish at night fishing, an underwater light for scuba diving, or a notice light for being attached to life jackets or lifeboats, the mount member 3 cannot be extended, cut off, bent, or warped by external force, thereby enabling securely to mount the chemical luminescence apparatus to the site to be positioned, so that a stable light source is obtained.

Next, the second embodiment of the chemical luminescence apparatus according to the present invention will now be described with reference to FIG. 15 through FIG. 21.

Figure 16:
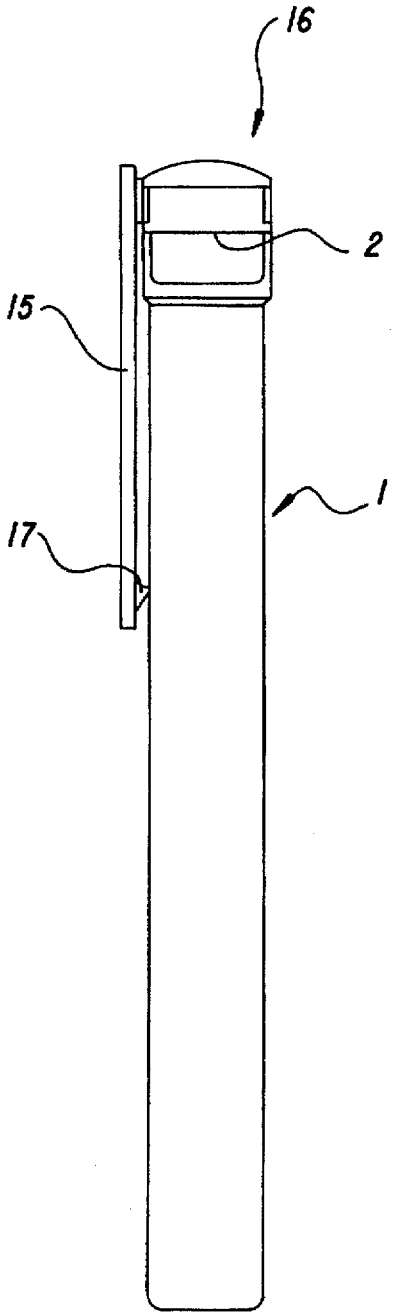
FIG. 16 is an elevational view of the second embodiment of the chemical luminescence apparatus according to the present invention.
Figure 17:
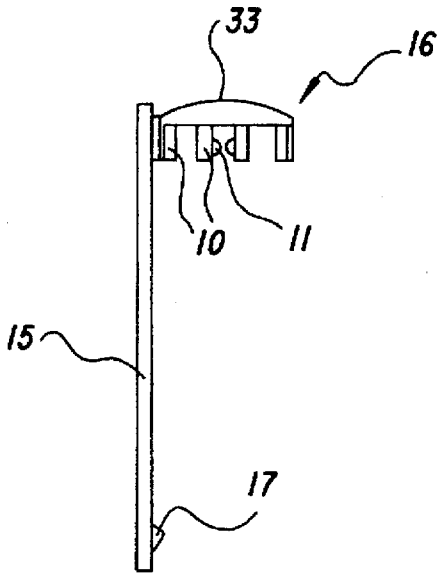
FIG. 17 is a clip-shaped mount member adapted to the second embodiment of the chemical luminescence apparatus.
Figure 19:
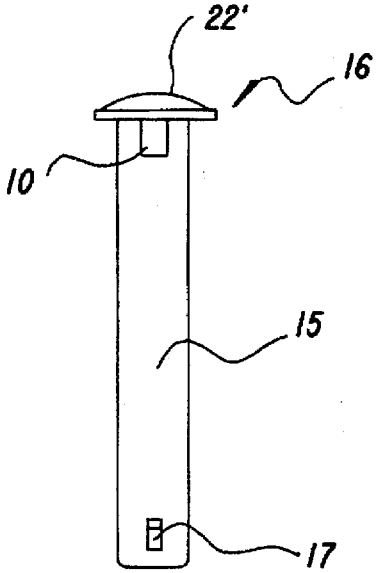
FIG. 19 is a right side view of the clip-shaped mount member shown in FIG. 17.
Figure 18:
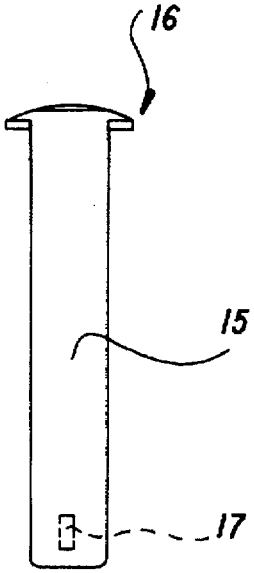
FIG. 18 is a left side view of the clip-shaped mount member shown in FIG. 17.
Figure 20:
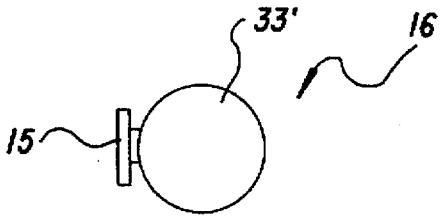
FIG. 20 is a plan view of the clip-shaped mount member shown in FIG. 17.
Figure 21:
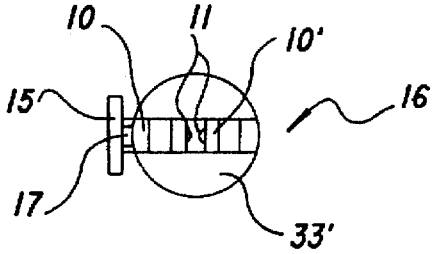
FIG. 21 is a bottom view of the clip-shaped mount member shown in FIG. 17.
Figure 22:
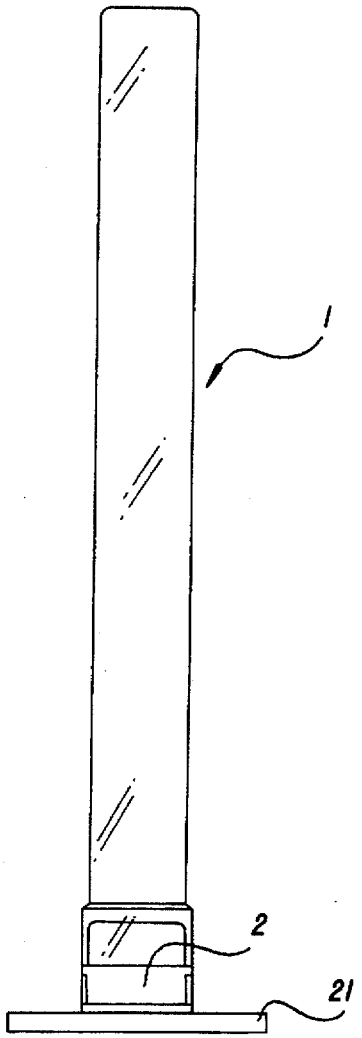
FIG. 22 is an elevational view of the third embodiment of the chemical luminescence apparatus according to the present invention.
Figure 23:
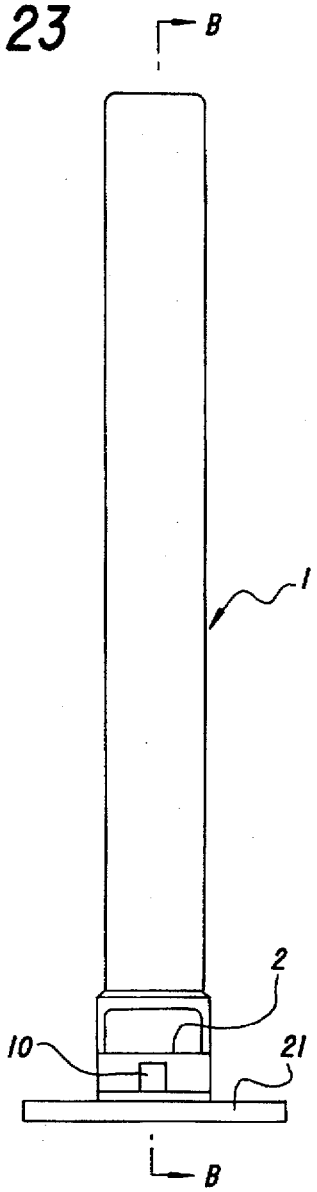
FIG. 23 is a right side view of the chemical luminescence apparatus shown in FIG. 22.
Figure 24:
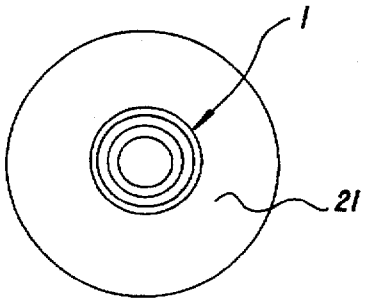
FIG. 24 is a plan view of the chemical luminescence apparatus shown in FIG. 22.
Figure 25:
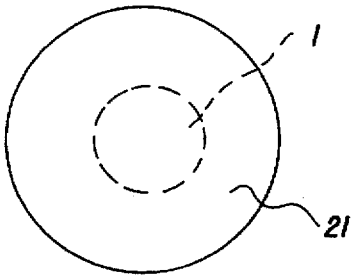
FIG. 25 is a bottom view of the chemical luminescence apparatus shown in FIG. 22.

As will be apparent from FIG. 15 and FIG. 16, the chemical apparatus, according to this embodiment, includes a clip-shaped, detachable mount member 16, in lieu of the mount member 3 as shown in the first embodiment, mounted to the top surface of the cap 2 which is fixed, by heat seal, as described above, to the upper end portion of the tube container 1.

As shown in FIG. 17 through FIG. 21, the mount member 16 of this embodiment is basically constituted as the same manner as that of the mount member 3 of the first embodiment, except that the mount member 16 comprises a clip portion 15 substitute for the hook portion 13 according to the first embodiment. That is, like the first embodiment, the mount member 16 includes a distal base portion 33' having a round upper surface and a flat lower surface, four substantially parallel upstanding walls 10, 10', 10', 10 extending substantially orthogonally from the lower surface of the base portion 33', and a clip portion 15 elongated downwardly in a vertical direction from the outside surface of one of the upstanding wall 10. The clip portion 15, having a detent 17 at the neighborhood of the lower end thereof so as not to be removed from the fixed member, is normally urged inwardly.

The second embodiment of the chemical luminescence apparatus having the mount member 16, constructed as described above, can be handy to carry, with the clip portion 15 clipped to a pocket 20 of a shirt 19 and the like, without having it by hand.

Next, the third embodiment of the chemical luminescence apparatus according to the present invention will now be described with reference to FIG. 22 through FIG. 35.

As will be apparent from FIG. 22, FIG. 23, FIG. 26 and FIG. 27, the chemical apparatus, according to this embodiment, includes a detachable stand member 21, in lieu of the hook-shaped mount member 3 as shown in the first embodiment, mounted to the top surface of the cap 2 which is fixed, by heat seal, as described above, to the upper end portion of the tube container 1, wherein the whole portion is turned upside down so that it stands on the table member.

As shown in FIG. 28 through FIG. 31, the stand member 21 according to this embodiment, is basically constituted as the same manner as that of the mount member 3 as described in the first embodiment, except that the stand member 21, cutting out the hook portion 13 from the mount member 3 of the first embodiment, includes a distal support member 22, which is larger in diameter than the base portion 33, mounted on the outer surface of the base portion 33, an opposite side thereof where the upstanding walls 10, 10' are mounted.

Figure 26:
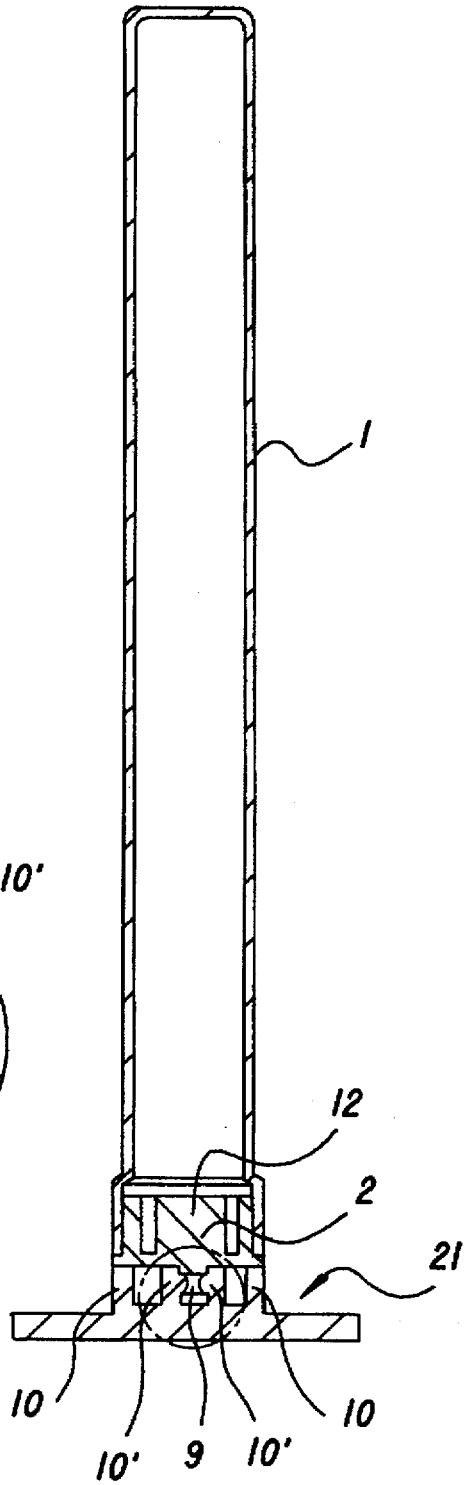
FIG. 26 is a sectional view as viewed in the direction of arrow B—B in FIG. 23.
Figure 26A:
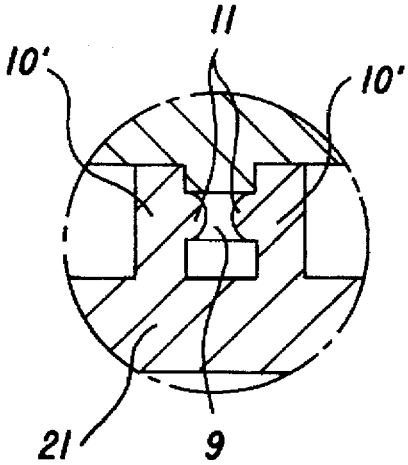
Figure 27:
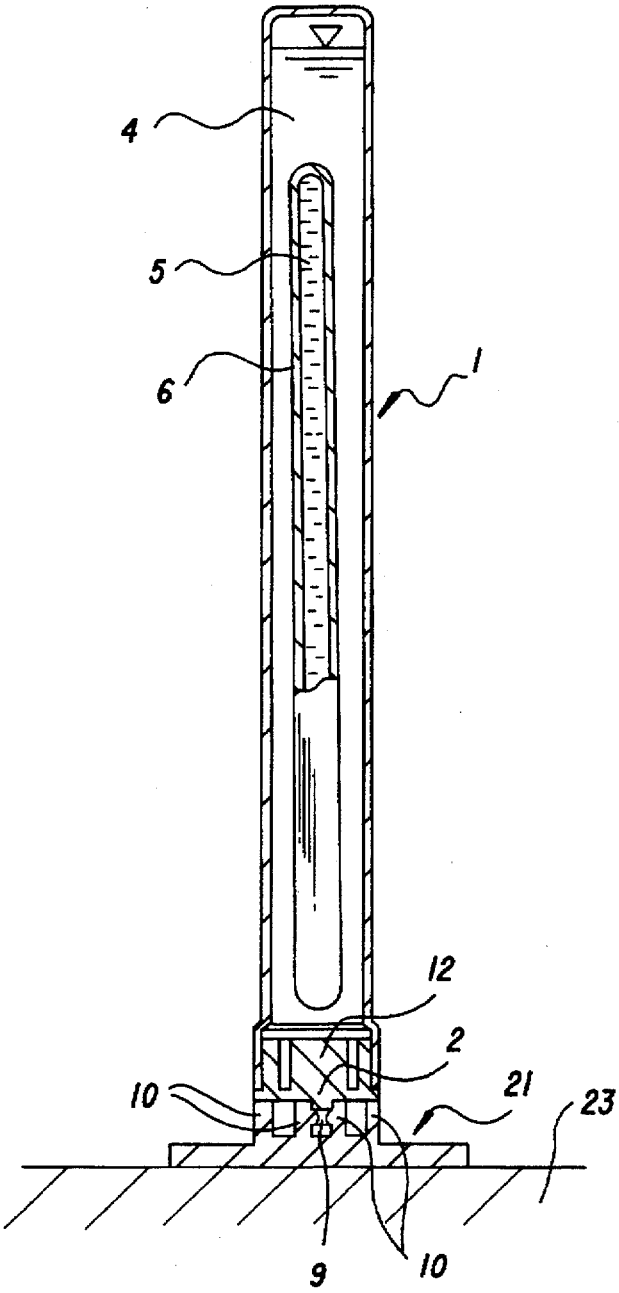
FIG. 27 is a fragmentary longitudinal sectional view of the third embodiment of the chemical luminescence apparatus in a using condition.
Figure 28:
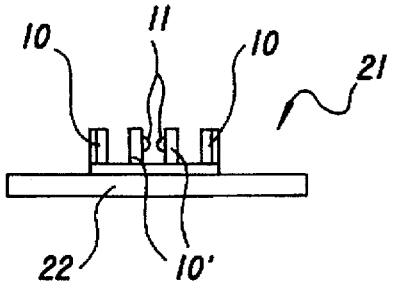
FIG. 28 is an elevational view of a stand member adapted to the third embodiment of the chemical luminescence apparatus.
Figure 29:
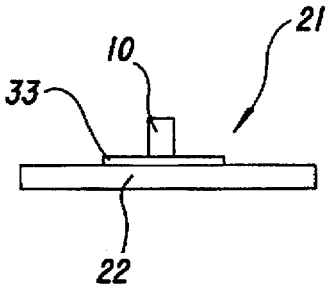
FIG. 29 is a right side view of the stand member shown in FIG. 28.
Figure 34:
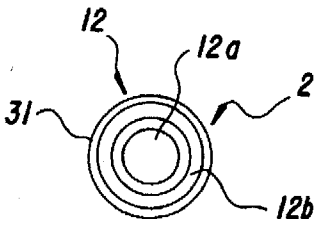
FIG. 34 is a plan view of the cap shown in FIG. 32.
Figure 35:
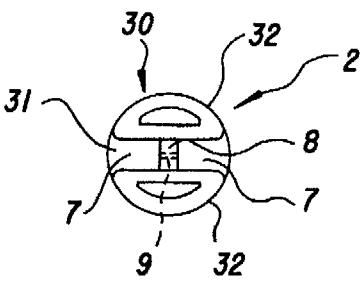
FIG. 35 is a bottom view of the cap shown in FIG. 32.
Figure 32:
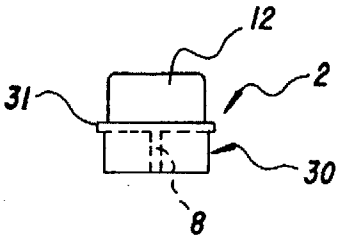
FIG. 32 is a cap adapted to the third embodiment of the chemical luminescence apparatus.
Figure 33:
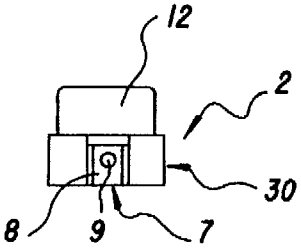
FIG. 33 is a right side view of the cap shown in FIG. 32.
Figure 30:
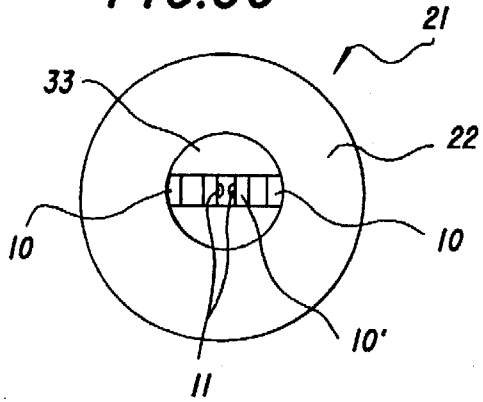
FIG. 30 is a plan view of the stand member shown in FIG. 28.
Figure 31:
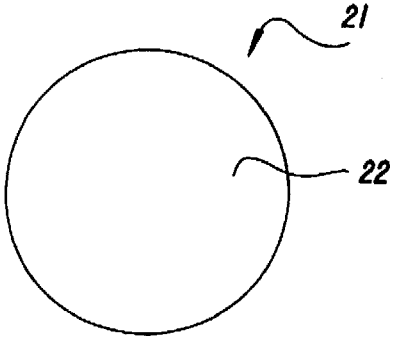
FIG. 31 is a bottom view of the stand member shown in FIG. 28.

As shown in FIG. 26(*a*), an enlarged fragmentary view thereof the stand member 21, according to this embodiment, constructed as described above, can be mounted to the cap 2, simply by positioning the stand member 21 so that the connecting member 8 of the cap 2 can be located at the space between the two inner upstanding walls 10', 10', and then pushing down the mount member 3 by hand easily fitting the inner upstanding walls 10', 10' into the groove 7 of the cap 2, with the detents 11 engaged to the connecting member 8. Thus, as shown in FIG. 27, the chemical luminescence apparatus, mounted on the stand member 21, can stand upright on the surface of the fixed member, such as table 23, with the tube container 1 vertical thereto. In this way, the tube container 1 stands perpendicular to the table 23, so that the tube container 1 can, equally and brightly, illuminate the surroundings.

Figure 36:
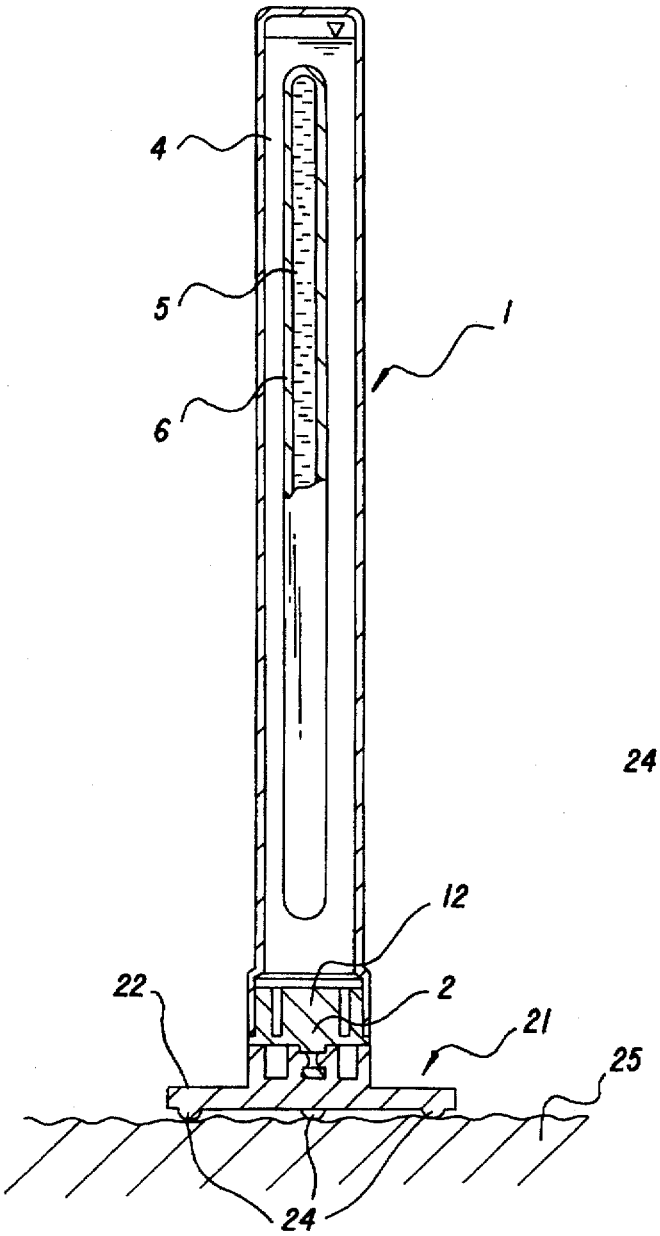
FIG. 36 is a fragmentary longitudinal sectional view of the fourth embodiment of the chemical luminescence apparatus in a using condition.
Figure 37:
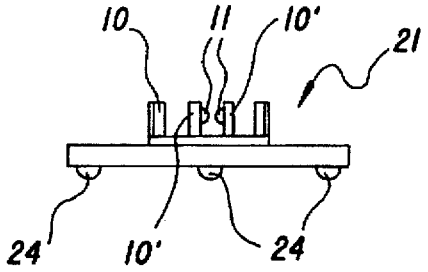
FIG. 37 is an elevational view of a stand member adapted to the fourth embodiment of the chemical luminescence apparatus.

Next, the fourth embodiment of the chemical luminescence apparatus according to the present invention will now be described with reference to FIG. 36 through FIG. 38.

Figure 38:
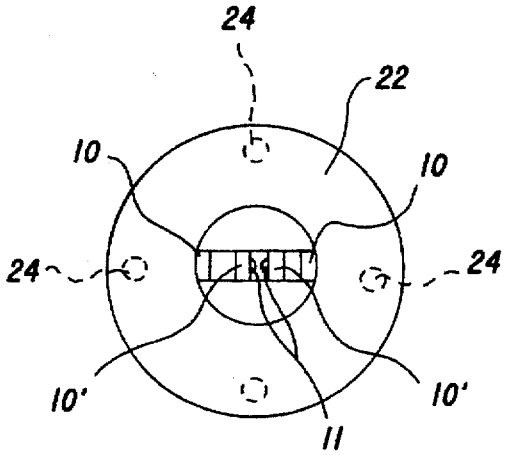
FIG. 38 is a plan view of the stand member shown in FIG. 37.
Figure 39:
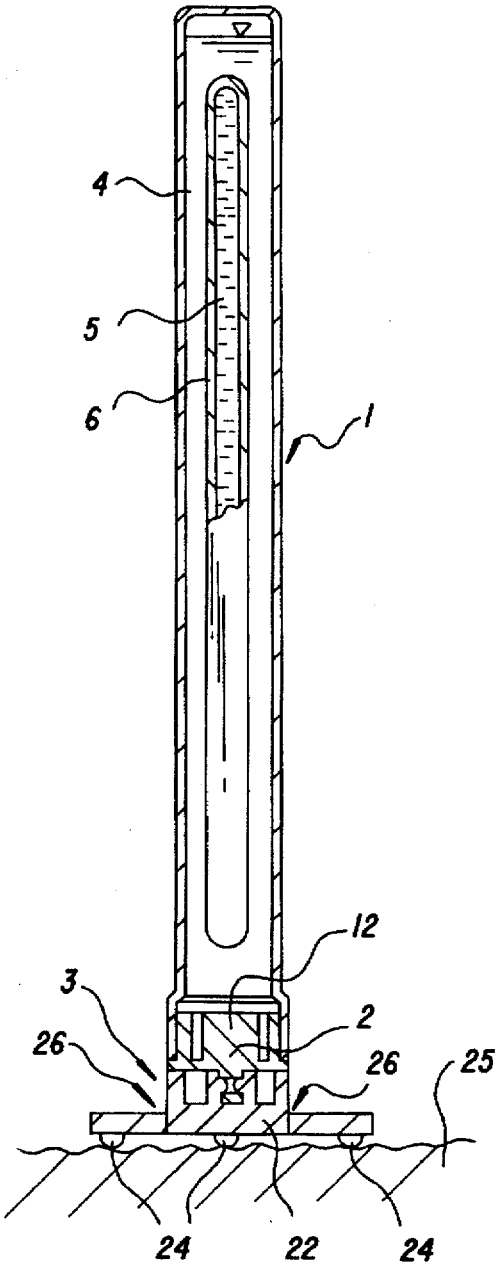
FIG. 39 is a fragmentary longitudinal sectional view of the fifth embodiment of the chemical luminescence apparatus in a using condition.

As will be apparent from FIG. 38, the chemical luminescence apparatus, according to this embodiment, is basically constituted as the same manner as that described in the third embodiment, except that the stand member 21 of this embodiment includes a support member 22 having a plural of, for example four, nodules 24 on the peripheral outer (bottom) surface of the support member 22.

Constructed as described above, the chemical luminescence apparatus, when placed on a table 25, having a rough surface, stands vertical to the table, by fitting the nodules 24 to the rough surface thereof. Obviously, the number of the nodules 24 is not limited to four but may take a suitable number according to necessity.

Next, the fifth embodiment of the chemical luminescence apparatus according to the present invention will now be described with reference to FIG. 39 through FIG. 42.

Figure 40:
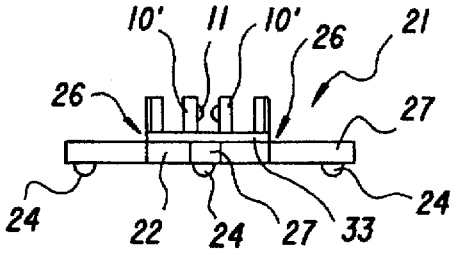
FIG. 40 is an elevational view of a stand member adapted to the fifth embodiment of the chemical luminescence apparatus.
Figure 41:
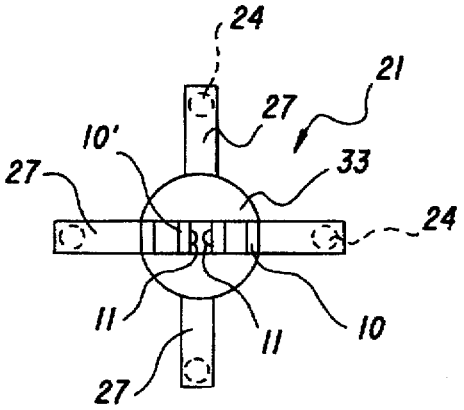
FIG. 41 is a plan view of the stand member shown in FIG. 40.
Figure 42:
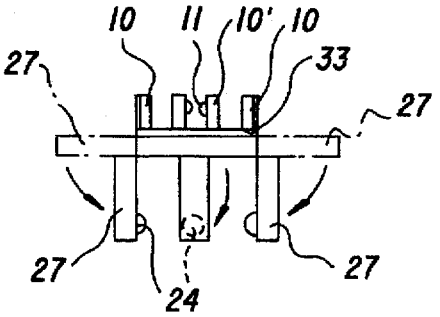
FIG. 42 is a elevational view of the stand member of FIG. 40 in a folding condition.
Figure 43:
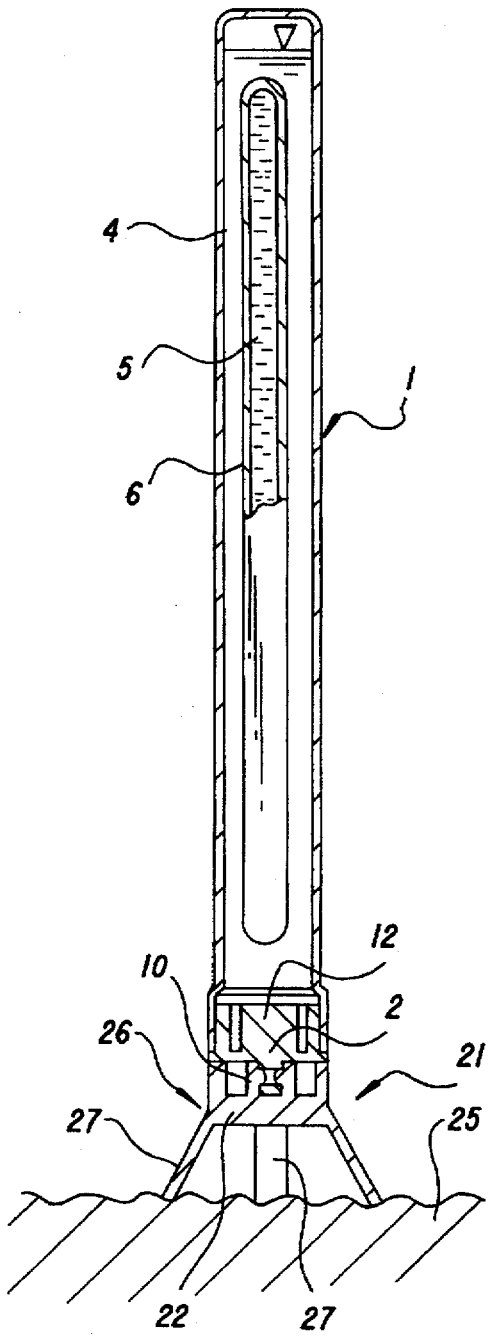
FIG. 43 is a fragmentary longitudinal sectional view of the sixth embodiment of the chemical luminescence apparatus in a using condition.
Figure 44:
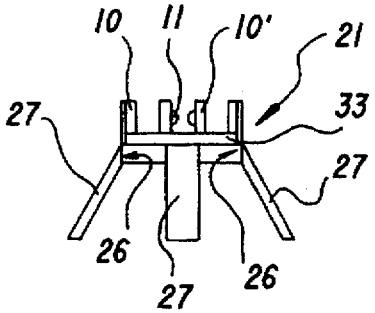
FIG. 44 is an elevational view of the stand member adapted to the sixth embodiment of the chemical luminescence apparatus.
Figure 45:
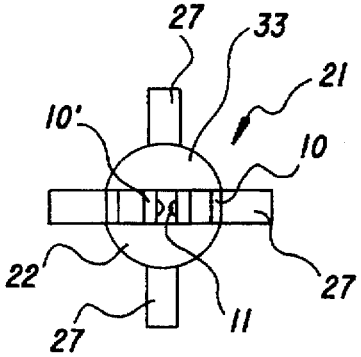
FIG. 45 is a plan view of the stand member shown in FIG. 44.

The chemical luminescence apparatus according to this embodiment includes a distal support member 22 which is almost as large as the cap 2 in diameter, four strips of legs 27, FIG. 41, radially elongated in a horizontal direction from the outer periphery of the support member 22 and mounted at regular intervals thereto, and a partial cut portion 26, FIG. 40, formed between the outer periphery of the support member 22 and the inner end of each legs 27, wherein the partial cut portion 26, as shown in FIG. 42, serves as a hinge by which the legs 27 can be rotatable downwardly with respect thereto. In addition, each legs 27 has a nodule 24 on the ground surface thereof.

Constructed as described above, the chemical luminescence apparatus, when placed on a table 25 having a rough surface, can stably stand vertical thereto, by fitting the nodules 24 to the rough surface thereof.

As shown in FIG. 42, because the legs 27 are collapsible, it is possible to keep or carry the stand member 21 in a compact position (a solid line in FIG. 42), whether it is mounted on the cap 2 or removed therefrom, so that the stand member 21, as well as the legs 27, are effectively prevented from being bulky or damaged and can be handy to carry.

In this embodiment, the partial cut portion 26 is formed between the support member 22 and the legs 27, but the partial cut portion 26 may otherwise be formed therebetween.

Next, the sixth embodiment of the chemical luminescence apparatus according to the present invention will now be described with reference to FIG. 43 through FIG. 46.

Figure 46:
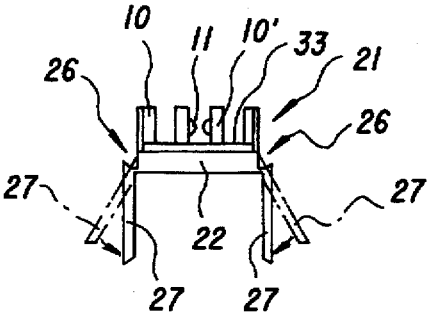
FIG. 46 is an elevational view of the stand member of FIG. 44 in a folding condition.
Figure 47:
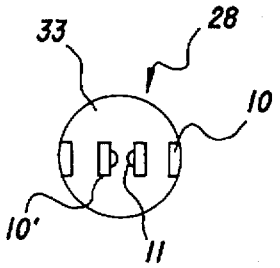
FIG. 47 is an elevational view of a coupler adapted to the seventh embodiment of the chemical luminescence apparatus according to the present invention.
Figure 48:
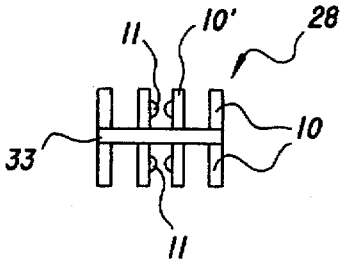
FIG. 48 is an elevational view of the coupler shown in FIG. 47.

As shown in FIG. 43 through FIG. 46, the stand member 21, according to this embodiment, is basically constituted as the same manner as that of the fifth embodiment except for the partial cut portion 26. That is, the chemical luminescence apparatus, according to this embodiment, includes a distal support member 22 which is almost as large as the cap 2 in diameter, four strips of legs 27, radially elongated in a downwardly slanting direction from the outer periphery of the support member 22 and mounted at regular intervals thereto, and a partial cut portion 26 formed on a boundary line between the outer periphery of the support member 22 and the inner end of each legs 27, wherein the partial cut portion 26, as shown in FIG. 46, extending vertically along the boundary line. The partial cut portion 26 serves as a hinge by which the legs 27 can be rotatable downwardly with respect thereto. As will be apparent from FIG. 46, the legs 27 can be downwardly rotatable with respect to the partial cut portion from the position shown by a phantom line to that shown by a solid line.

Constructed as described above, the tube container 1, when placed on a table 25 having a rough surface, can stably stand vertical thereto, because the legs 27 are not only pushed down due to self-weight of the apparatus but also fitted to the rough surface of the table 25.

As shown in FIG. 46, because the legs 27 are collapsible, it is possible to keep or carry the stand member 21 in a compact position (a solid line), whether it is mounted on the cap 2 or removed therefrom, so that the stand member 21, as well as the legs 27, while effectively prevented from being bulky or damaged, can be handy to carry.

Further, the stand member 21 can be easily replaced with an alternate optimum stand member, as shown in the foregoing third to fifth embodiment, depending on the surface conditions, such as shape, of the table member on which the tube container 1 is placed.

In this embodiment, like the foregoing fifth embodiment, the partial cut portion 26 may not be formed between the support member 22 and the legs 27.

Next, the seventh embodiment of the chemical luminescence apparatus according to the present invention will now be described with reference to FIG. 47 through FIG. 51.

Figure 49:
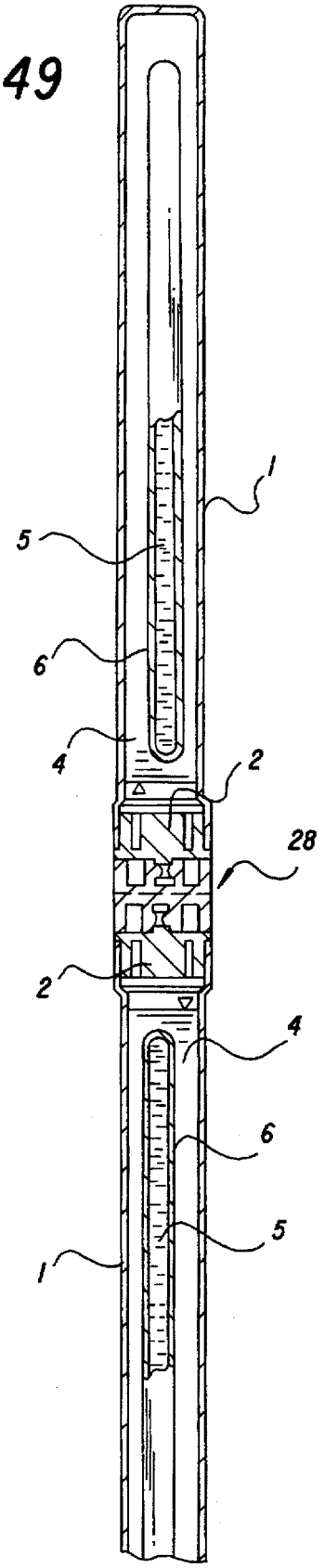
FIG. 49 is a fragmentary longitudinal sectional view of the seventh embodiment of the chemical luminescence apparatus in a using condition.
Figure 50:
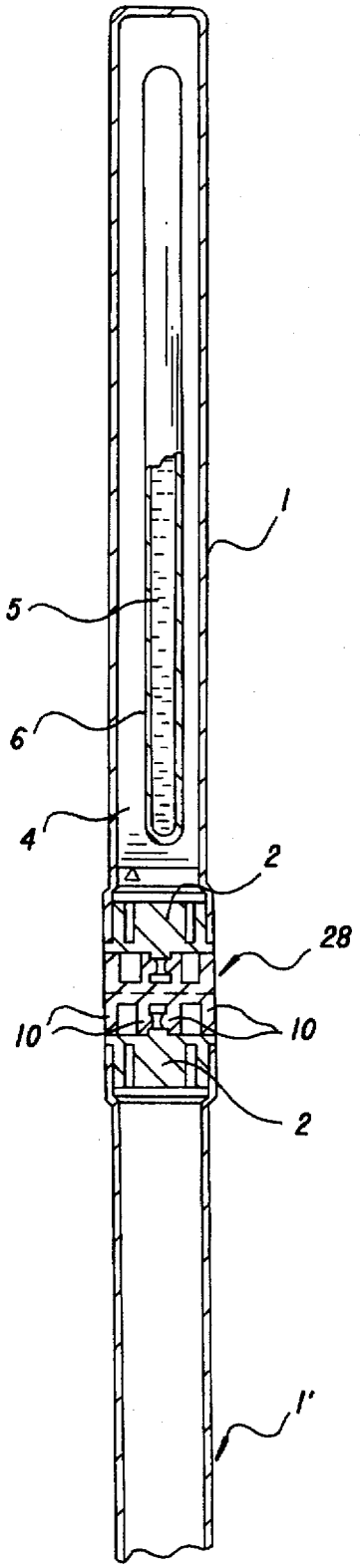
FIG. 50 is a fragmentary longitudinal sectional view of the seventh embodiment of the chemical luminescence apparatus in another use condition.

As shown in FIG. 49 and FIG. 50, the chemical luminescence apparatus, according to this embodiment, includes a coupler 28 comprising a distal base portion 33, each sides of which forming upstanding walls 10, 10' thereon, whereby two tube containers 1, 1 can be coupled in series, with each top ends thereof butted against each other. That is, as will be apparent from FIG. 47 and FIG. 48, the coupler 28 is formed a mirror symmetry with respect to base portion 33, wherein the similar constitution of the upstanding walls 10, 10' according to the foregoing embodiments are formed on each sides of the base portion 33.

As shown in FIG. 49, when the two tube containers 1, 1 of the chemical luminescence apparatus are coupled in series, the luminous portion thereof is doubled in length, thereby improving visibility from a distance and signal function thereof. Further, when the two tube containers 1, 1, each having a different luminous color, are coupled, the functions of such apparatus, such as a guidance light, an emergency light, or a signal light, are further improved by the change of luminous color. Furthermore, it is possible to sequentially illuminate the chemical luminescence apparatus; that is, one of the tube container illuminates first, and then the other illuminates next.

Still further, as shown in FIG. 50, the chemical luminescence apparatus, used for a guidance light or an emergency light, comprises two tube containers 1, 1' coupled in series with each other, one of which contains illuminating materials therewithin (tube container 1) while the other one is empty (empty tube container 1'), so that visibility of the apparatus cannot be impaired, if the empty container 1' is grasped by hand, without shielding the luminous portion of the tube container 1.

If the chemical luminescence apparatus is kept in such a separated condition that the foregoing coupler 28 is attached to one of the tube container 1 or empty tube container 1', it is easy to connect the two tube container 1, 1' by simply mounting the one to the other, and the loss of the coupler 28 is effectively prevented.

Figure 51:
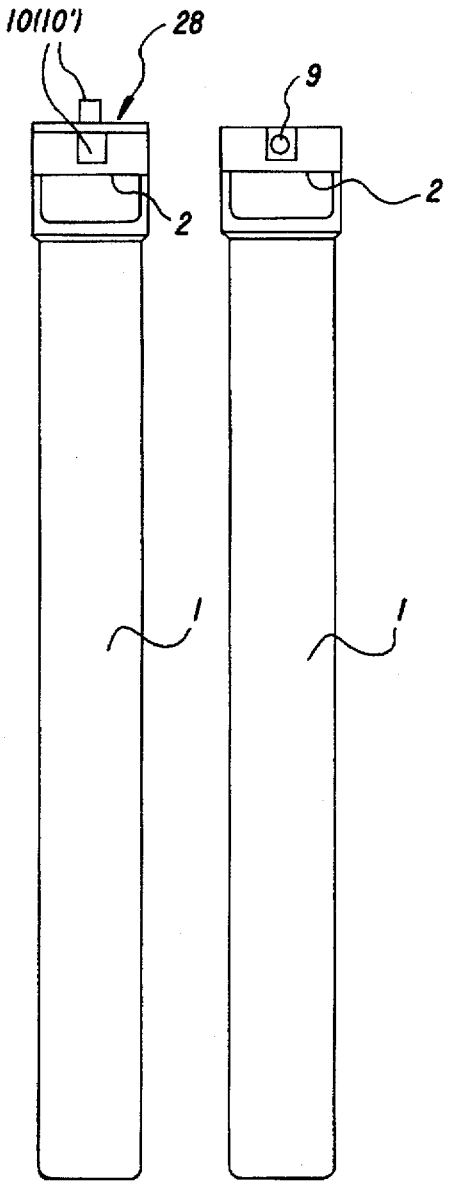
FIG. 51 is an elevational view of the seventh embodiment useful to explain the separate condition thereof.

Thus, as shown in FIG. 51, the chemical luminescence apparatus of this embodiment is convenient to keep and handy to carry, because the two tube containers 1, 1 can be kept or packed in a separated, compact condition.

Because the coupler 28, like other attachments, such as the hook-shaped mount member 3, the clip-shaped mount member 16, or the stand member 21, is detachably mounted to the tube container 1, it is easy to interchange attachment members.

In case of using each chemical luminescence apparatus, according to the above mentioned embodiments of the present invention, under circumstances where strong external force is applied, such as a tide, wind pressure, a hard contact with other objects, and the like, a detent means, which prevents such attachments as the mount member, the stand member, or the coupler from being removed from the tube container, is needed, while sustaining detachability thereof.

Figure 52:
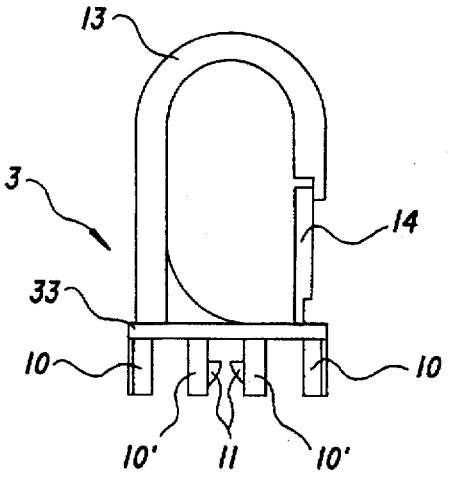
FIG. 52 is an elevational view of one example of a lock portion formed on a detent of the mount member, the stand member, or the coupler so that they cannot be easily removed from the cap of the chemical luminescence apparatus.
Figure 53:
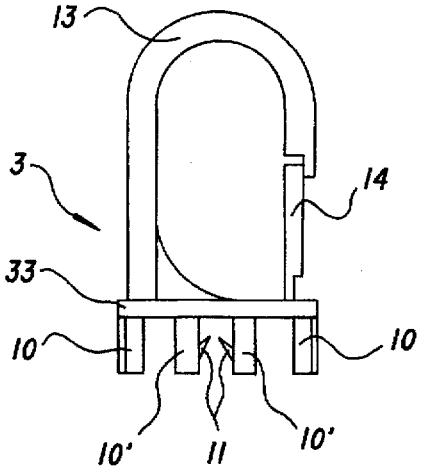
FIG. 53 is an elevational view of another example of the lock portion.

In view of the foregoing necessity, the detent means, as shown in FIG. 52 and FIG. 53, for example, can achieve the object, by modifying the shape of the detent 11 of the inner upstanding wall 10' of the attachment such as the mount member 3, 16, the stand member 21, or the coupler 28. For example, the mount member 3 of FIG. 52 includes a detent portion 11, disposed at the inner surface of the inner upstanding wall 10', having a flat portion formed at the upper end thereof, which is to be fitted in the aperture 9 of the cap 2, while the mount member 3 of FIG. 53 includes a wedge-shaped detent portion 11, disposed at the inner surface of the inner upstanding wall 10'.

In the chemical luminescence apparatus having the detent portion, constructed as described above, the attachments, such as, the mount member 3, 16, stand member 21, or coupler 28, are so firmly engaged to the cap 2 of the tube container 1 that those attachments cannot be easily removed therefrom even under the foregoing unusual circumstances.

As a consequence, the chemical luminescence apparatus, according to the present invention, can be more widely available.

In the foregoing illustrated examples, the mount member 3 is mounted to the tube container 1 in such a manner that the upstanding walls 10, 10', disposed at the lower end of the mount member 3, are fitted in the groove 7 of the cap 2, but a mount portion which can be inserted into the aperture 9 of the connecting member 8 may be formed at the lower end of the mount member 3. Such modified examples will now be described in detail with reference to FIG. 54 through FIG. 57.

Figure 54:
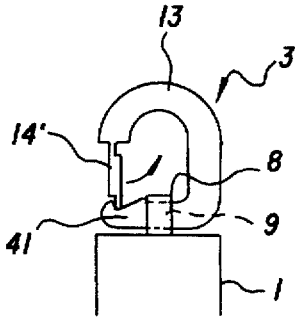
FIG. 54 is an elevational view of one modified example of the hook-shaped mount member.

One embodiment of a mount member 3, as shown in FIG. 54, includes a hook portion 13 having a detent strip 14', normally urged to close an opening portion thereof, and a mount portion 41 having a detent pawl, formed at the tip of the bottom portion thereof, to be inserted into the aperture 9 of the connecting member 8 of the cap 2.

Figure 55:
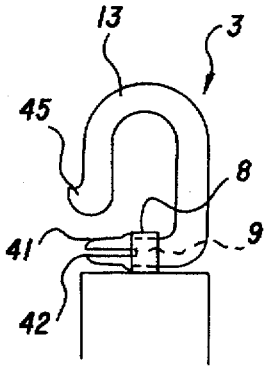
FIG. 55 is an elevational view of another modified example of the hook-shaped mount member.

Another embodiment of the mount member 3, as shown in FIG. 55, includes a hook portion 13 having a detent strip 45, projecting outwardly at the lower end of the vertical tip portion 13*a* adjacent to the opening portion thereof, and a mount portion 41 having a detent pawl, formed at the tip of the bottom portion thereof, to be inserted into the aperture 9 of the connecting member 8 of the cap 2, wherein the mount portion 41 comprises a split portion 42.

Figure 56:
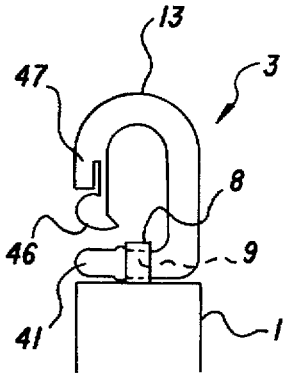
FIG. 56 is an elevational view of still another modified example of the hook-shaped mount member.

Still another embodiment of the mount member 3, as shown in FIG. 56, includes a hook portion 13 having a detent strip 46, projecting inwardly at the lower end of the vertical tip portion 13*a* adjacent to the opening portion thereof, and a mount portion 41 having a detent pawl, formed at the tip of the bottom portion thereof, to be inserted into the aperture 9 of the connecting member 8 of the cap 2, wherein the vertical tip portion 13*a* comprises a stopper 47 to restrain the outward motion of the detent strip 46.

Figure 57:
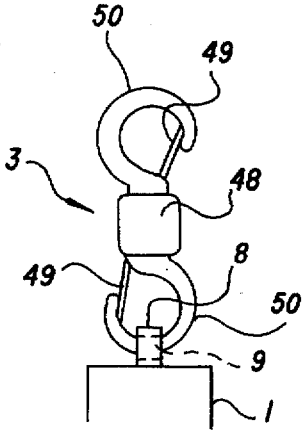
FIG. 57 is an elevational view of yet another modified example of the hook-shaped mount member.

Yet another embodiment of the mount member 3, as shown in FIG. 57, includes two semicircular hooks 50, 50, each having a detent strip 49 normally urged to close an opening portion thereof, and a hook link member 48 for rotatably connecting, about a vertical axis thereof, with the two hooks 50, 50, wherein one of the hooks 50 is inserted into the aperture 9 of the connecting member 8 of the cap 2, so that the mount member 3 can be mounted to the tube container 1.

Further, in the foregoing illustrated example, the cap 2 is fixed, by heat seal, to the opening portion of the tube container 1 due to the friction heat, generated by rotation of the cap 2 frictionally around the inner surface of the tube container 1, but the cap 2 and the tube container 1 may be fixed by ultrasonic welding, and the like.

Furthermore, the materials of the tube container 1 and the cap 2 are not limited to PP (polypropylene), but other materials such as PE (polyethylene) may be used. Also, the materials of the mount member 3, 16, the stand member 21, or the coupler 28 are not limited to PP (polypropylene), but other materials such as PE (polyethylene), ABS (acrylonitrile butadien styrene) may be used for one of the preferred embodiment.

Obviously, materials other than transparent resins may alternately be used for the tube container, the cap, the mount member, the stand member, or the coupler, and the materials thereof are not necessarily identical.

Additionally, a loop of string, a rubber band, or a metal clasp can be engaged to the cap of the tube container.

What is more, a suction disc or an adsorbent may be mounted on the lower surface of the support member of the stand member, and the shape from the plan view thereof is not limited to circle but may take a suitable form, such as semicircle, triangle, or polygon, in consideration of the cutting of material and the prevention of stress concentration.

As hereinbefore pointed out, according to the present invention, there are obtained excellent and wide range of effects by which the use of the chemical luminescence apparatus can be diversified, thereby enabling the practical value thereof to be greatly enhanced.

While the instant invention has been shown and described with specific reference to embodiments presently contemplated as the best mode of carrying out the invention in actual practice, it is to be understood that various changes may be in adapting the invention to different embodiments without departing from the broader inventive concepts disclosed herein and comprehend by the claim which follow.

What is claimed is:

1. A chemical luminescence apparatus, comprising:

a tube container having an open top, said tube container containing a first chemical luminous liquid and an ampul, said ampul containing a second chemical luminous liquid chemically reactive with said first chemical luminous liquid for forming a luminescent reaction material;

a cap hermetically sealing said open top; and a snap on mount member having an engaging portion, said mount member being snappably detachable onto said cap.

2. A chemical luminescence apparatus, comprising:

a tube container having an open top, said tube container containing a first chemical luminous liquid and an ampul, said ampul containing a second chemical luminous liquid chemically reactive with said chemical luminous liquid for forming a luminescent reaction liquid;

a cap hermetically sealing said open top at a lower portion of said cap, said cap having a groove, elongated in a diametrical direction thereof, at an upper portion thereof, said groove being partitioned by a connecting member having an aperture therethrough; and a mount member including an engaging portion at an upper portion of said mount member and a plural of upstanding walls at a lower portion of said mount member, said upstanding walls being engaged with said connecting member and fitted in said groove, wherein said upstanding walls having a detent to be fitted in said aperture of said connecting member.

3. A chemical luminescence apparatus, comprising:

a tube container having an open top, said tube container containing a first chemical luminous liquid and an ampul, said ampul containing a second chemical luminous liquid which is chemically reactive with said first chemical luminous liquid and forming a luminescent reaction liquid;

a cap hermetically sealing said open top at a lower portion of said cap, said cap having a groove, elongated in a diametrical direction of said cap, at an upper portion of said cap, said groove being partitioned by a connecting member having an aperture therethrough; and a mount member, including an engaging portion at an upper portion of said mount member and a mount portion at a lower portion of said mount member, said mount portion being detachably mounted to said aperture of said connecting member, wherein said mount portion has a detent portion.

4. A chemical luminescence apparatus, comprising:

a tube container having an open top, said tube container containing a first chemical luminous liquid and an ampul, said ampul containing a second chemical luminous liquid which is chemically reactive with said first chemical luminous liquid for forming a luminescent reaction liquid;

a cap hermetically sealing said open top at a lower portion of said cap portion, said cap having a groove, elongated in a diametrical direction of said cap, at an upper portion of said cap, said groove, partitioned by a connecting member, having an aperture therethrough; and a mount member including two semicircular hooks rotatably disposed, with respect to a vertical axis, at upper and lower portions, respectively, each of said hooks having a detent strip normally urged to close an opening portion of said hook, wherein one of said hooks inserted into said aperture of said connecting member of said cap, thereby detachably mounting said mount member on said cap.

5. A chemical luminescence apparatus as recited in claim 1, 2, 3, or 4, wherein said engaging portion comprises a hook.

6. A chemical luminescence apparatus as recited in claim 1, 2, 3, or 4, wherein said engaging portion comprises a clip.

7. A chemical luminescence apparatus as recited in claim 1, 2, 3, or 4, wherein said mount member is made of a material more rigid than the material of said tube container.

8. A chemical luminescence apparatus as recited in claim 3, wherein said detent portion comprises a detent pawl.

9. A chemical luminescence apparatus as recited in claim 3, wherein said detent portion comprises a split portion at the tip portion of said detent portion.

10. A chemical luminescence apparatus as recited in claim 2, wherein said detent of one of said upstanding walls of said mount member, said stand member, and said coupler includes a locking strip for preventing release thereof from said cap.

11. A chemical luminescence apparatus as recited in claim 1, 2, 3, or 4 wherein said tube container is made of transparent material.

* * * * *